US007815440B2

(12) United States Patent
Hsieh et al.

(10) Patent No.: US 7,815,440 B2
(45) Date of Patent: Oct. 19, 2010

(54) ELECTRICAL CONTACT WITH INTERLOCKING ARRANGEMENT

(75) Inventors: Wen-Yi Hsieh, Tu-Cheng (TW); Ke-Hao Chen, Tu-Cheng (TW); Shih-Wei Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/538,878

(22) Filed: Aug. 11, 2009

(65) Prior Publication Data

US 2010/0035483 A1 Feb. 11, 2010

(30) Foreign Application Priority Data

Aug. 11, 2008 (TW) ..... 97214361 U
Aug. 11, 2008 (TW) ..... 97214373 U

(51) Int. Cl.
*H01R 4/48* (2006.01)

(52) U.S. Cl. ..... 439/66

(58) Field of Classification Search ..... 439/816, 439/131, 700, 66, 76, 67
See application file for complete search history.

(56) References Cited

U.S. PATENT DOCUMENTS

| | | | | |
|---|---|---|---|---|
| 7,025,602 | B1 * | 4/2006 | Hwang | 439/66 |
| 7,467,952 | B2 * | 12/2008 | Hsiao et al. | 439/66 |
| 7,545,159 | B2 * | 6/2009 | Winter | 324/761 |
| 7,559,769 | B2 * | 7/2009 | Hsiao et al. | 439/66 |
| 2009/0311886 | A1 * | 12/2009 | Hsieh et al. | 439/66 |
| 2010/0055934 | A1 * | 3/2010 | Hsieh et al. | 439/65 |

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical contact comprises an upper contact pin, a lower contact pin and a spring enveloping between the upper contact pin and the lower contact pin. The upper contact pin has an upper contacting portion and a guiding portion, and the lower contact pin is coupled to the upper contact pin and has a lower contacting portion and a main portion extending from the contacting portion. The main portion of the lower contact pin includes two elastic arms, and each elastic arm has a first and a second locking protrusions engaging with a slot defined on the guiding portion of the upper contact pin respectively to reliably connect the upper contact pin and the lower contact pin.

18 Claims, 8 Drawing Sheets

ELECTRICAL CONTACT WITH INTERLOCKING ARRANGEMENT

BACKGROUND OF THE INVENTION

Field of the Invention

The present invention relates to an electrical contact, and more particularly, to an electrical contact having an upper contact pin and a lower contact pin moveably interlocked with each other and used in burn-in test socket.

U.S. Pat. No. 7,025,602 issued to Hwang on Apr. 11, 2006, and foreign counterpart Chinese Patent No. 101156282 both disclose a conventional contact for burn-in test socket, the conventional contact has an upper contact pin, a lower contact pin and a spring disposed therebetween. The upper contact pin has a contact part having a predetermined shape and contacting a lead of the electronic device, two support protrusions, and a body. The lower contact pin is coupled to the upper contact pin to be orthogonal to the upper contact pin. The spring envelops over a predetermined area between the upper and lower contact pins.

The upper contact pin and the lower contact pin have the same structures. The lower contact also has a contact part, two support protrusions, and a body. The body includes two longitudinally two symmetrical elastic parts. A hook is provided at a bottom end of each elastic part. And a rib portion is provided between the two elastic parts for preventing unintentional separation of the upper contact pin and the lower contact pin after the upper contact pin and the lower contact pin are coupled to each other.

The conventional contact described above has following disadvantages. Usually, the upper contact pin and the lower contact pin are coupled to each other only by the hooks interlocked to the rib portion, so that the upper contact pin can be readily popped out because the interlock therebetween is too weak to hold them together. In this case, electrical signals may not be satisfactorily transmitted between the upper contact pin and the lower contact pin. Consequently, the contact can not efficiently perform its function.

Hence, it is desirable to provide an improved electrical contact to overcome the aforementioned disadvantages.

SUMMARY OF THE INVENTION

An object of the present invention is to provide an electrical contact comprising an upper contact pin and a lower contact pin reliably coupled with the upper contact pin.

In order to achieve the above-mentioned object, an electrical contact comprises an upper contact pin, a lower contact pin and a spring enveloping over a predetermined area between the upper contact pin and the lower contact pin. The upper contact pin has an upper contacting portion and a guiding portion, the guiding portion defines a pair of longitudinal channels at two opposite sides thereof and a slot on a bottom wall of the channel. The lower contact pin is coupled to the upper contact pin, the lower contact has a lower contacting portion and a main portion extending from the contacting portion, the main portion of the lower contact pin includes two symmetrical elastic arms sliding along the channels of the upper contact pin, the elastic arm has a first locking protrusion and a second locking protrusion engaging with the slot of the upper contact pin respectively.

Other features and advantages of the present invention will become more apparent to those skilled in the art upon examination of the following drawings and detailed description of preferred embodiments.

DETAILED DESCRIPTION OF PREFERRED EMBODIMENT

Figure 1:
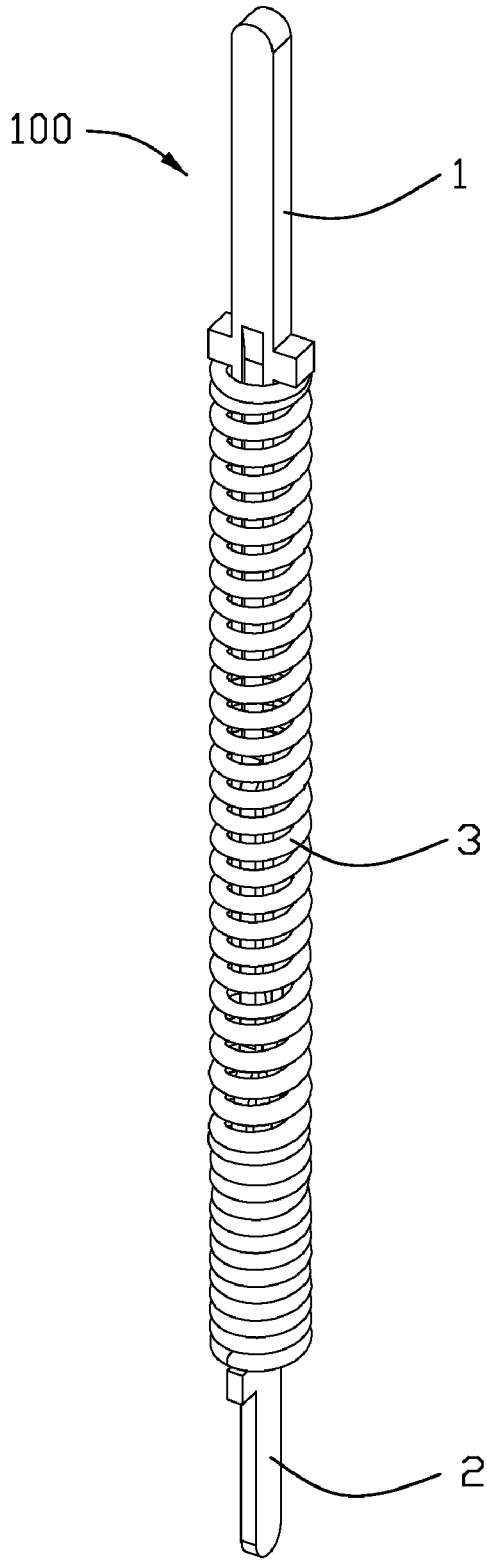
FIG. 1 is an assembled perspective view of an electrical contact in a first embodiment in accordance with the present invention.
Figure 2:
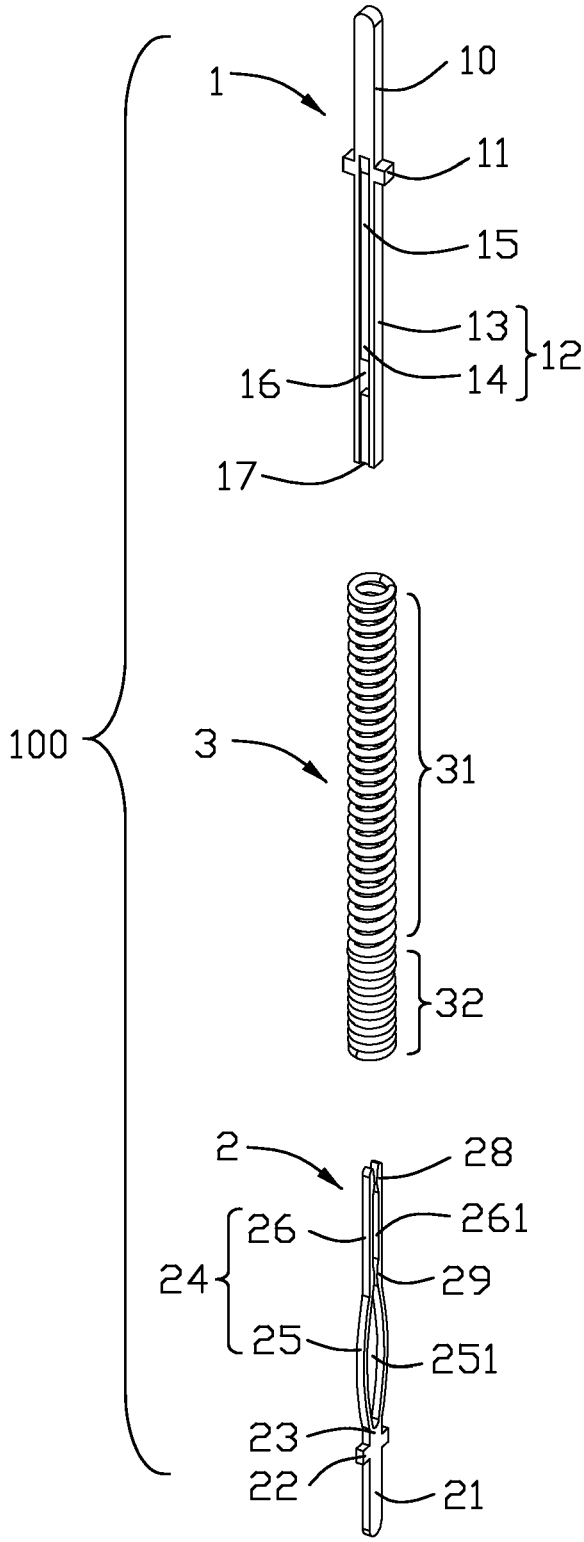
FIG. 2 is an exploded perspective view of the electrical contact of FIG. 1.

Reference will now be made to the drawing figures to describe the preferred embodiments of the present invention in detail.

Referring to FIGS. 1 to 4, an electrical contact 100 of a first embodiment in accordance with the present invention is adapted for being arranged in a test socket or a burn-in socket for receiving an IC package and electrically connecting the IC package to a PCB for testing an IC package when it is seated onto the socket. In such a state, the test socket performs a test to the IC. The electrical contact 100 comprises an upper contact pin 1, a lower contact pin 2 and a spring 3 enveloping over a predetermined area between the upper contact pin 1 and the lower contact pin 2.

Figure 3:
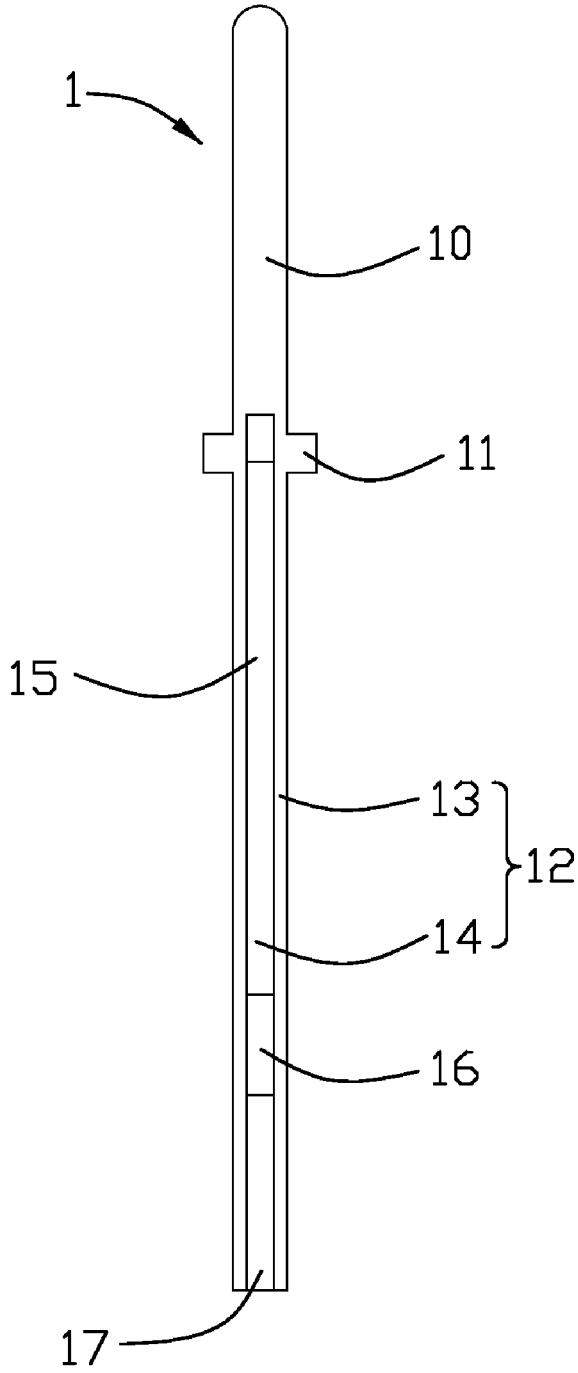
FIG. 3 is a front perspective view of an upper contact pin of the electrical contact of FIG. 1.

As shown in FIG. 3, the upper contact pin 1, stamped from a metal piece, includes a slender upper contacting portion 10 with a point top end for contacting with the IC package. An upper projecting portion 11 is provided on lateral sides of a bottom end of the contacting portion 10 for limiting the spring 3. The upper projecting portion 11 is perpendicular to the contacting portion 10 which extends uprightly. The spring 3 is positioned under the upper projecting portion 11, and will not move over the upper projecting portion 11 since a transverse length of the upper projecting portion 11 is wider than a diameter of the spring 3. A guiding portion 12 extends downwardly and vertically to the upper projecting portion 11 for leading a vertical motion of the lower contact pin 2.

The guiding portion 12 includes a pair of leading arms 13 which are symmetrical and parallel with respect to each other and a clapboard 14 disposed between and connecting the two leading arms 13. Because the clapboard 14 is thinner than the leading arms 13, so the leading arms 13 and the clapboard 14 together define a pair of longitudinal channels 15 at two opposite sides of the guiding portion 12 for the lower contact pin 2 to be received in and moving freely in a vertical direction. The guiding portion 12 further defines a slot 16 on a bottom wall of the channel 15 and near the bottom end thereof, the slot 16 may run through the clapboard 14.

Figure 4:
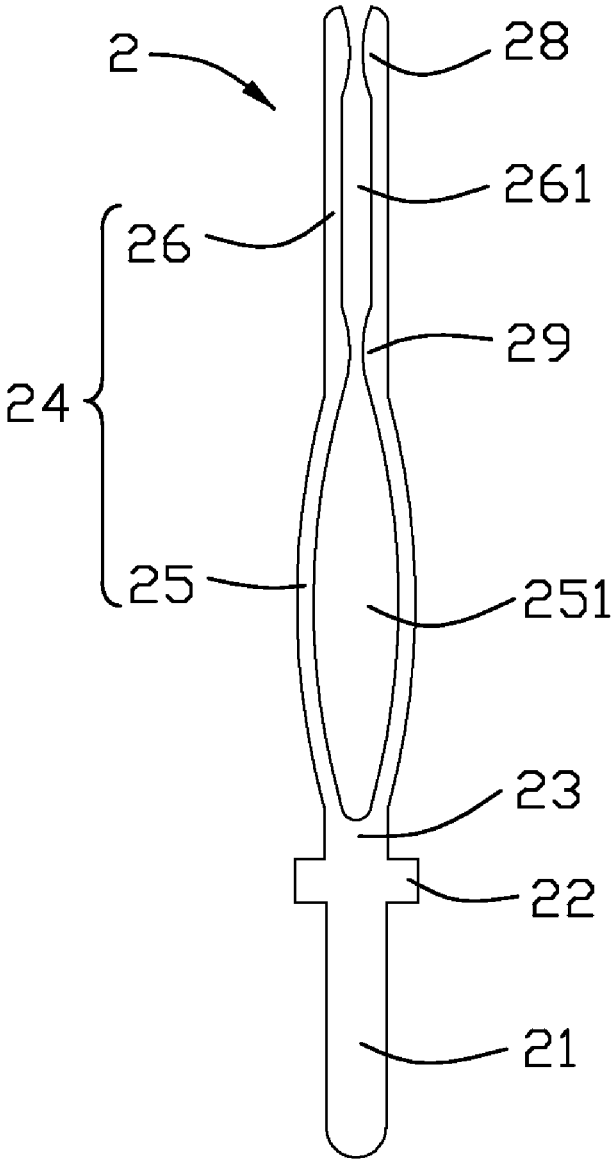
FIG. 4 is a front perspective view of a lower contact pin of the electrical contact of FIG. 1.

Referring to FIG. 4, the lower contact pin 2 is also produced from a sheet metal and includes a lower contacting portion 21 for connecting with the PCB, a lower projecting portion 22 formed on a top end of the lower contacting portion 21 and extending horizontally over two sides of the lower contacting portion 21, and a main body 23 extending upwardly from the lower projecting portion 22 and being perpendicular to the lower projecting portion 22. The lower projecting portion 22 can limit a bottom end of the spring 3. A transversal length of the lower projecting portion 22 is wider than the diameter of the spring 3 to restrict a downward movement of the spring 3, thereby the spring 3 will not easily slide away from the lower contact pin 2.

The main body 23 includes two longitudinally elastic arms 24 which are symmetrically arranged with respect to each other. Each elastic arm 24 includes an arc-shaped lower part 25 and a slender upper part 26. An elliptic first receiving room 251 is formed between the two arc-shaped lower parts 25 of the elastic arms 24 for receiving a free bottom end 17 of the guiding portion 12 of the upper contact pin 1. A pair of first locking protrusions 28 extend inwardly and toward to each other from top ends of the upper parts 26 of the elastic arms 24. And another pair of second locking protrusions 29 extend inwardly and toward to each other from bottom ends of the upper parts 26 of the elastic arms 24. A second receiving room 261 is defined between the first locking protrusions 28 and the second locking protrusions 29. The second receiving room 261 connects with the first receiving room 251. When the upper contact pin 1 moves along a vertical direction with respect to the lower contact pin 2, the first locking protrusions 28 and the second locking protrusions 29 are received in the slot 16 of the upper contact pin 1 in turn to locking the lower contact pin 2 with the upper contact pin 1.

The spring 3 extends exteriorly around the guiding portion 12 of the upper contact pin 1 and the main body 23 of the lower contact pin 2. An upper end and the bottom end of the spring 3 abut against the upper projecting portions 11 of the upper contact pin 1 and the lower projecting portions 22 of the lower contact pin 2 for positioning the spring 3 respectively. The spring 3 can be compressed and moves up and down. The spring 3 includes a loosely arranged first spring ring 31 and a densely arranged second spring ring 32 located below the first spring ring 31. The second spring ring 32 can be set peripherally around of the arc-shaped lower part 25 of the lower contact pin 2.

When assembling, the spring 3 is firstly enveloped over the guiding portion 12 of the upper contact pin 1, then compress the spring 3, and the two elastic arms 24 of the lower contact pin 2 are respectively received in the channels 15 of the upper contact pin 1. At an initial position, the first locking protrusions 28 of the lower contact pin 2 are locked into the slot 16 of the upper contact pin 1, and the free bottom end 17 of the guiding portion 12 is received in the second receiving room 261 of the lower contact pin 2. The lower contact pin 2 is coupled to the upper contact pin 1 to be orthogonal to the upper contact pin 1. The two elastic arms 24 of the lower contact pin 2 can move along the channels 15 of the upper contact pin 1 in a vertical direction.

When the assembly of the electrical contact 100 is completed, the spring 3 is limited between the upper projecting portion 11 and the lower projecting portion 22 for providing an repulsive force therebetween. The first loose spring ring 31 of the spring 3 is set around the guiding portion 12 of the upper contact pin 1, and the slender upper part 26 of the lower contact pin 2. And the second densely spring ring 32 is set around the arc-shaped lower part 25 of the lower contact pin 2. Because the arc-shaped lower part 25 can lean against the second densely spring ring 32, so that the lower contact pin 2 is tightened the spring 3 to provide a larger interferential force and form a stable connection with the upper contact pin 1. The contacting portion 10 of the upper contact pin 1 can connect with the IC package and the contacting portion 21 of the lower contact pin 2 can connect with the PCB respectively. When the lower contact pin 2 upwardly moves relative to the upper contact pin 1, the second locking protrusions 29 of the lower contact pin 2 will slide and be locked into the slot 16 of the upper contact pin 1, so the upper contact pin 1 and the lower contact pin 2 are tightly coupled to each other so as to realize the electrical connection of the electrical contact 100.

The electrical contact 100 of the present invention has some advantages as follow. The first locking protrusions 28 and the second locking protrusions 29 of the lower contact pin 2 can respectively and alternatively engage with the slot 16 of the upper contact pin 1. Thus it can allow the upper contact pin 1 and the lower contact pin 2 keep connecting with each other and stably electrically contacting each other. Furthermore, the assembly process of the electrical contact 100 is easier than the conventional contact. In addition, the second densely spring ring 32 can tighten the arc-shaped lower part 25 so as to form a larger interference force and provide a stable connection between the first contact pin 1 and the second contact pin 2.

As shown in FIGS. 5 to 8, an electrical contact 100' of a second embodiment in accordance with the present invention includes an upper contact pin 1', a lower contact pin 2' and a spring 3' enveloping over a predetermined area between the upper contact pin 1' and the lower contact pin 2'.

Figure 5:
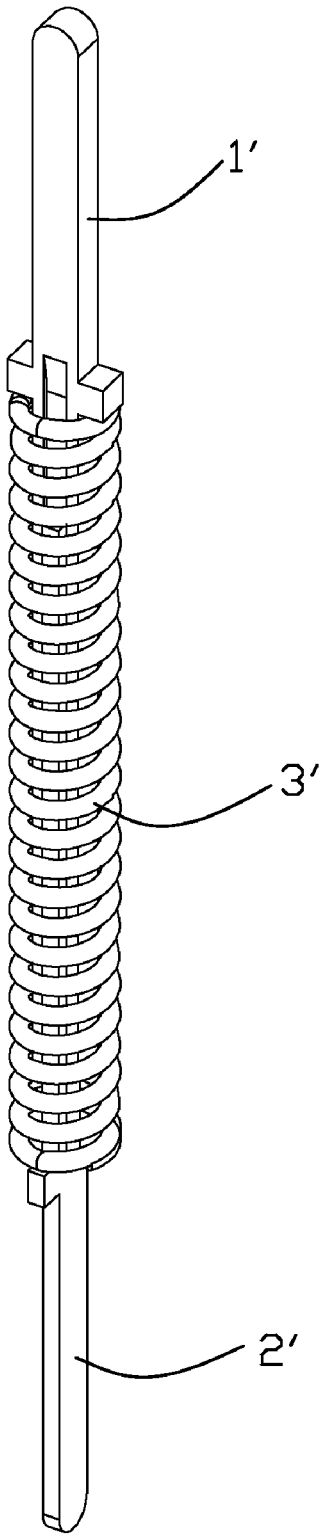
FIG. 5 is an assembled perspective view of an electrical contact in a second embodiment in accordance with the present invention.
Figure 7:
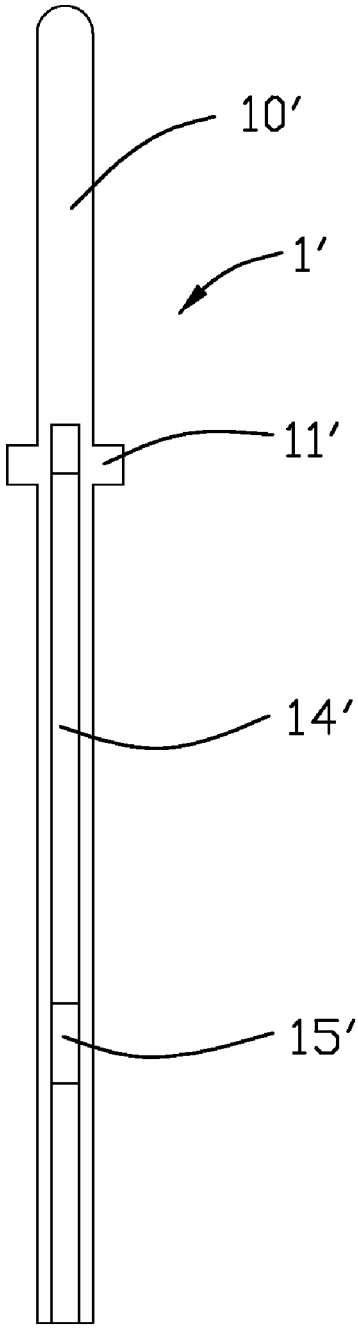
FIG. 7 is a front perspective view of an upper contact pin of the electrical contact of FIG. 5.

Referring to FIGS. 5 and 7, since the upper contact pin 1' of the electrical contact 100' according to the second embodiment has the same structure and function as the upper contact pin 1 of the electrical contact 100 in the first embodiment, the upper contact pin 1' will not be described in detail hereinafter. The upper contact pin 1' also includes a contacting portion 10', a pair of upper projecting portions 11' for limiting the spring 3', a guiding portion 12' including a pair of guiding channels 13' for the lower contact pin 2' to move in, a clapboard 14' between the two guiding channels 13', and a slot 15' running through the clapboard 14' for positioning the lower contact pin 2'.

Figure 6:
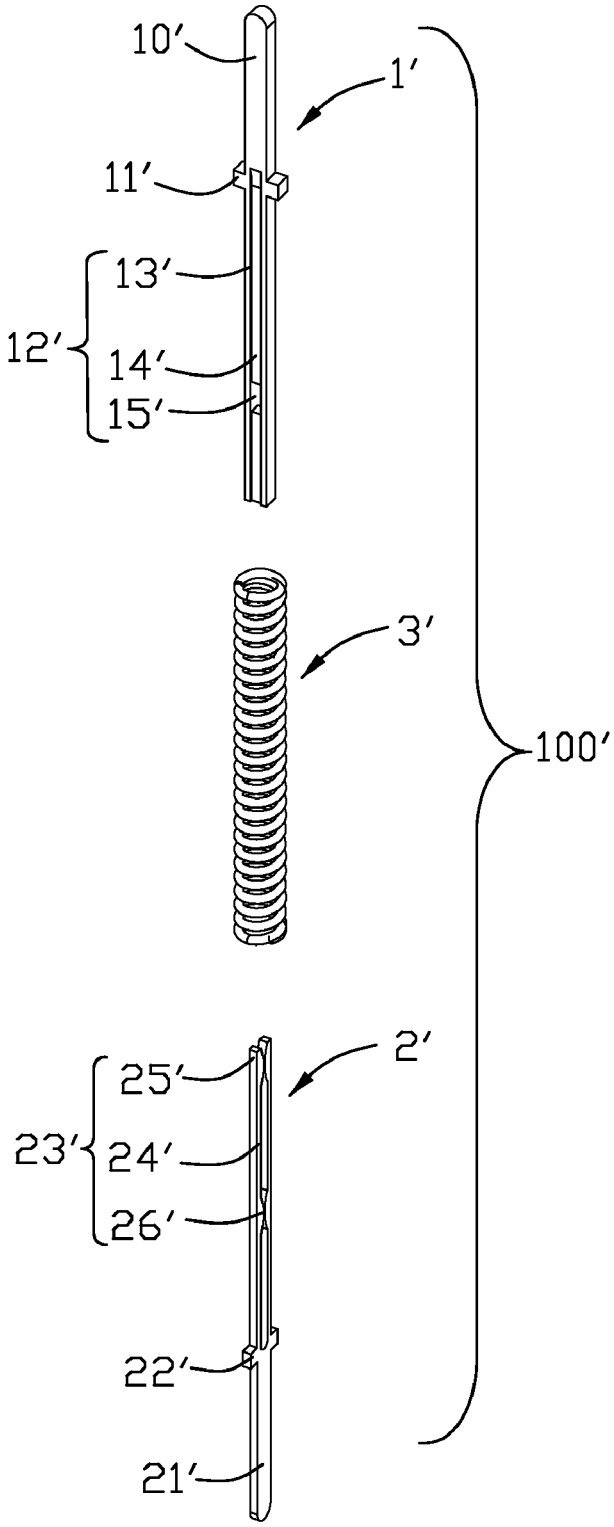
FIG. 6 is an exploded perspective view of the electrical contact of FIG. 5.
Figure 8:
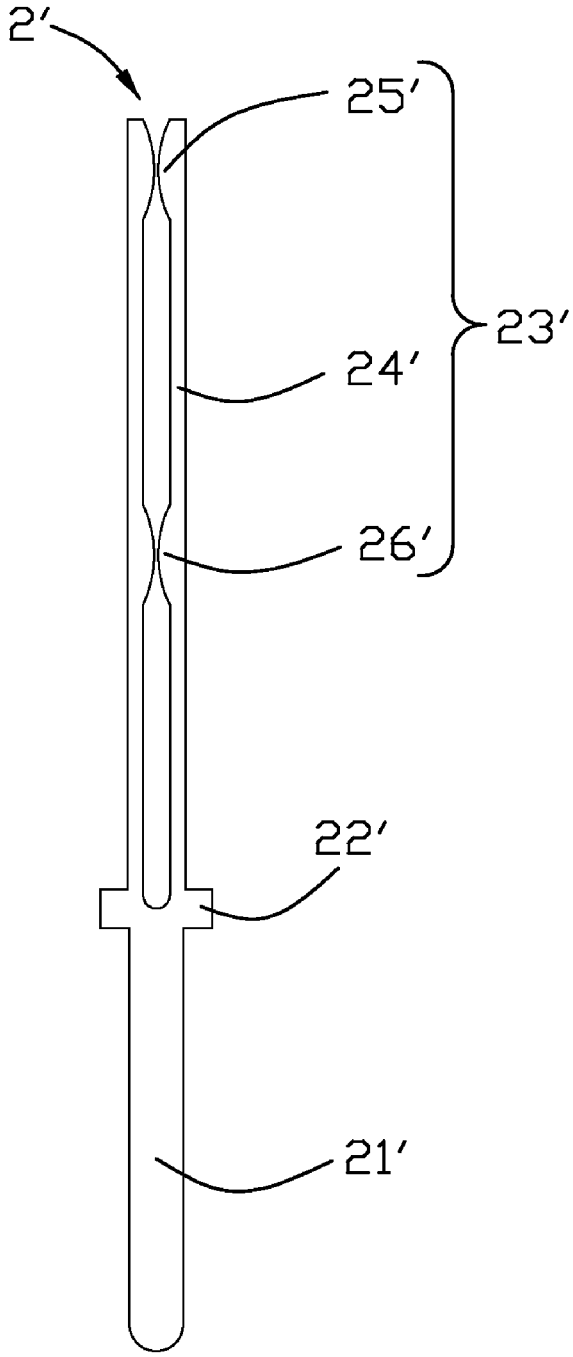
FIG. 8 is a front perspective view of a lower contact pin of the electrical contact of FIG. 5.

As shown in FIGS. 6 and 8, the lower contact pin 2' has a similar structure as the lower contact pin 2 in the first embodiment. The lower contact pin 2' also includes a contacting portion 21 for connecting with the PCB, a lower projecting portion 22' extending outwardly from the top end of the contacting portion 21', and a main body 23' extending upwardly and vertically from the lower projecting portion 22'. The lower projecting portion 22' can limit a bottom end of the spring 3'.

The main body 23' in the second embodiment is different from the main body 23 in the first embodiment. The main body 23' includes two longitudinal elastic arms 24' which are symmetrical arranged with respect to each other. The elastic arms 24' includes a pair of first locking protrusions 25' and a pair of second locking protrusions 26' extending inwardly and toward each other. The pair of first locking protrusions 25' extend from the top ends of the elastic arms 24'. And the pair of second locking protrusions 26' extends from middle parts of the elastic arms 24'. When the upper contact pin 1' moves along a vertical direction with respect to the lower contact pin 2', the first locking protrusions 25' and the second locking protrusions 26' can alternatively be located in the slot 15' of the upper contact pin 1'. Thus, the upper contact pin 1' and the lower contact pin 2' can be coupled to each other both in an initial position and a final position. Furthermore, the lower contact pin 2' can move along the guiding channels 13' up and down, and the two pair of locking protrusions 25' can engage with guiding channels 13' and be received in the slot 15' of the clapboard 14'. Thus the electrical contact 100' could provide a steady contacting and has a low contacting impedance.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical contact for being arranged in a test socket to receive an IC package and electrically connecting to a PCB, comprising:

an upper contact pin, stamped from a metal piece, having an upper contacting portion and a guiding portion, the guiding portion defining a pair of longitudinal channels at two opposite sides thereof and a slot on a bottom wall of the channel;

a lower contact pin coupled to the upper contact pin, the lower contact having a lower contacting portion and a main portion extending from the lower contacting portion, the main portion of the lower contact pin including two symmetrical elastic arms slidable along the channels of the upper contact pin, the elastic arm having a first locking protrusion and a second locking protrusion engaging with the slot of the upper contact pin respectively;

the lower contact pin includes a pair of lower projecting portions extending over two sides of the lower contacting portion from a top end of the lower contacting portion for limiting the spring;

each elastic arm includes an arc-shaped lower part extending upwardly from the lower projecting portion and a slender upper part extending upwardly from the lower part to engage with the upper contact pin;

the guiding portion of the upper contact pin includes a pair of leading arms parallel to each other and a clapboard disposed between the two leading arms and connecting the two leading arms;

the clapboard is thinner than the two leading arms, and the channels are provided between the two leading arms and at two sides of the clapboard to allow movement of the lower contact pin;

the slot is defined near a bottom end of the clapboard and runs through the clapboard; and a spring enveloping over a predetermined area between the upper contact pin and the lower contact pin.

2. The electrical contact as described in claim 1, wherein; an upper projecting portion is provided on lateral sides of a bottom end of the upper contacting portion for limiting the spring.

3. The electrical contact as described in claim 2, wherein; the upper projecting portion is perpendicular to the upper contacting portion which extends uprightly.

4. The electrical contact as described in claim 3, wherein an elliptic first receiving room is defined between the two arc-shaped lower parts of the elastic arms of the lower contact pin for receiving a free bottom end of the guiding portion of the upper contact pin.

5. The electrical contact as described in claim 3, wherein the spring includes a loosely arranged first spring ring and a densely arranged second spring ring located below the first spring ring.

6. The electrical contact as described in claim 5, wherein the second spring ring of the spring can be set around a peripheral of the arc-shaped lower part of the lower contact pin.

7. The electrical contact as described in claim 3, wherein each of the elastic arms has the first locking protrusion and the second locking protrusion, and the first and second locking protrusions extend inwardly from inner sides of the elastic arms of the lower contact pin.

8. The electrical contact as described in claim 7, wherein the first locking protrusion extends from a top end of the upper part of the elastic arm, and the second locking protrusions extends from a bottom end of the upper part of the elastic arm.

9. The electrical contact as described in claim 7, wherein; a guiding portion extends downwardly and vertically to the upper projecting portion.

10. The electrical contact as described in claim 9, wherein; the lower contact pin is made of a metal sheet.

11. The electrical contact as described in claim 10, wherein; the lower contact portion is connected to the printed circuit board.

12. An electrical contact for being arranged in a test socket to receive an IC package and electrically connecting to a PCB, comprising:

an upper contact pin, having an upper contacting portion and a guiding portion, the guiding portion defining a pair of longitudinal channels at two opposite sides thereof and a slot on a bottom wall of the channel; and a lower contact pin having a lower contacting portion and a main portion extending from the lower contacting portion, the main portion of the lower contact pin including two symmetrical elastic arms slidable along the channels of the upper contact pin, the elastic arm having a first stop and a second stop engaging with the slot of the upper contact pin respectively;

the lower contact pin includes a pair of lower projecting portions extending over two sides of the lower contacting portion from a top end of the lower contacting portion for limiting the spring;

each elastic arm includes an arc-shaped lower part extending upwardly from the lower projecting portion and a slender upper part extending upwardly from the lower part to engage with the upper contact pin;

the guiding portion of the upper contact pin includes a pair of leading arms parallel to each other and a clapboard disposed between the two leading arms and connecting the two leading arms;

the clapboard is thinner than the two leading arms, and the channels are provided between the two leading arms and at two sides of the clapboard to allow movement of the lower contact pin;

the slot is defined near a bottom end of the clapboard and runs through the clapboard;

a spring enveloping over a predetermined area between the upper contact pin and the lower contact pin.

13. The electrical contact as described in claim 12, wherein; the lower contact pin is made of a metal sheet.

14. An electrical contact assembly for being arranged in a test socket to receive an IC package and electrically connecting to a PCB, comprising:

a deflectable contact defining two spaced elastic arms extending along a lengthwise direction thereof with a space therebetween, each of said elastic arms including at least one contacting protrusion extending to the other and slidable along the channels of an stiff contact; and the stiff contact defining an I-shaped cross-section along said lengthwise direction, the stiff contact having an upper contacting portion and a guiding portion, the guiding portion defining a pair of longitudinal channels at two opposite sides thereof; wherein said pair of elastic arms engages said stiff contact in an intersectional and perpendicular manner under condition that said contacting protrusion is essentially protectively shielded in a corresponding channel formed in said I-shaped cross-section; wherein said I-shaped cross-section is interrupted at one position in said lengthwise direction so as to form a stopper area to retain the corresponding contacting protrusion thereabout; wherein said stopper area is a recess or in form of a through hole, into which said contacting protrusion is embedded.

15. The electrical connector assembly as claimed in claim 14, wherein each of said elastic arms further includes another contacting protrusion spaced from said contacting protrusion with a distance along said lengthwise direction.

16. The electrical connector assembly as claimed in claim 15, wherein; the deflectable contact is made of a metal sheet.

17. The electrical connector assembly as claimed in claim 16, wherein; the deflectable contact is connected to the printed circuit board.

18. The electrical connector assembly as claimed in claim 16, wherein, the stiff contact is made of a metal sheet.

* * * * *